US005374132A

United States Patent [19]

Kimura

[11] Patent Number: 5,374,132

[45] Date of Patent: Dec. 20, 1994

[54] TAPE PRINTER APPARATUS

[75] Inventor: Satoshi Kimura, Oome, Japan

[73] Assignee: Casio Computer Co., Ltd., Tokyo, Japan

[21] Appl. No.: 133,970

[22] Filed: Oct. 8, 1993

[30] Foreign Application Priority Data

Oct. 15, 1992 [JP] Japan ..... 4-305038

[51] Int. Cl.[5] ..... B41J 11/48

[52] U.S. Cl. ..... 400/586; 400/587; 400/594; 400/613; 395/102

[58] Field of Search ..... 400/120, 586, 587, 594, 400/613; 346/134; 395/102

[56] References Cited

U.S. PATENT DOCUMENTS

| | | | |
|---|---|---|---|
| 3,803,628 | 4/1974 | Van Brimer et al. . | |
| 4,569,584 | 2/1986 | St. John et al. . | |
| 4,814,893 | 3/1989 | Katoh . | |
| 4,927,278 | 5/1990 | Kuzuya et al. . | |
| 4,965,590 | 10/1990 | Yamazaki . | |
| 4,966,476 | 10/1990 | Kuzuya et al. . | |
| 4,976,558 | 12/1990 | Kuzuya et al. . | |
| 4,983,058 | 1/1991 | Nagae . | |
| 5,009,530 | 4/1991 | Kuzuya et al. . | |
| 5,222,818 | 6/1993 | Akiyama et al. | 400/120 |
| 5,253,334 | 10/1993 | Kimura et al. | 400/586 |

FOREIGN PATENT DOCUMENTS

| | | |
|---|---|---|
| 0322918 | 7/1989 | European Pat. Off. . |
| 0449465A2 | 10/1991 | European Pat. Off. . |
| 0451830A2 | 10/1991 | European Pat. Off. . |
| 1-173381 | 7/1989 | Japan . |

OTHER PUBLICATIONS

"Ribbon Cartridge Detection"; Research Disclosure, Feb. 1988, No. 286; New York, N.Y., p. 77.

*Primary Examiner*—Edgar S. Burr
*Assistant Examiner*—John S. Hilten
*Attorney, Agent, or Firm*—Frishauf, Holtz, Goodman & Woodward

[57] ABSTRACT

In a tape printer apparatus, tape cassettes containing tape members of different widths are selectively mounted, and input printing data is printed on the tape member of the mounted tape cassette. The tape cassettes are provided with notches indicating the widths of the contained tape members. The presence or absence of the notch of the mounted cassette case is detected by ON or OFF of switches disposed in a cassette mounting portion of an apparatus case. Based on a result of this detection, the tape width is determined, and a printing matching with the tape width is performed.

7 Claims, 15 Drawing Sheets

52

| | |
|---|---|
| A | [ 1X1 ] |
| B | [ 1X1 ] |
| C | [ 1X1 ] |
| LF | [ 1X1 ] |
| C | [ 1X1 ] |
| ⋮ | ⋮ |
| L | [ 1X1 ] |
| T | [ 1X1 ] |
| D | [ 1X1 ] |
| • | [ 1X1 ] |
| J | [ 2X2 ] |
| a | [ 2X2 ] |
| P | [ 2X2 ] |
| a | [ 2X2 ] |
| n | [ 2X2 ] |
| STOP | |
| | |

FIG.5B

| WIDTH OF TAPE | WIDTH OF CASSETTE | SHAPE OF NOTCH | SW1 | SW2 | SW3 |
|---|---|---|---|---|---|
| A (6mm) | A' | 70A 71b 81 | ON | OFF | OFF |
| B (9mm) | B' | 70B 71b | ON | OFF | ON |
| C (12mm) | C' | 70C 71b 81 | ON | ON | OFF |
| D (18mm) | D' | 70D 71b | ON | ON | ON |
| NO CASSETTE LOADING | | — | OFF | OFF | OFF |

FIG.6

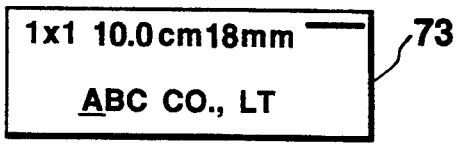
FIG.11A
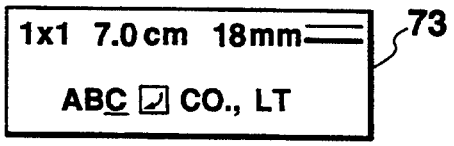
FIG.11B
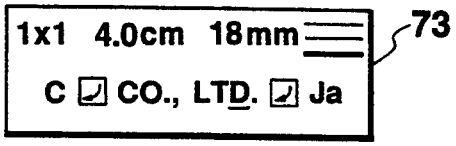
FIG.11C
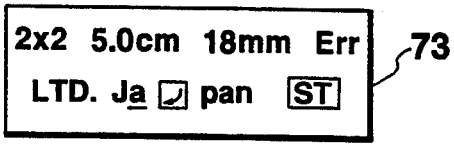
FIG.11D
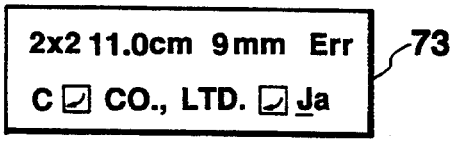
FIG.11E
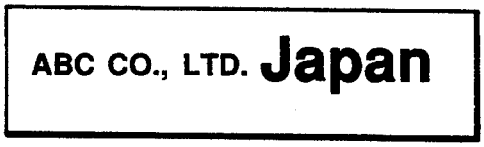
FIG.12A
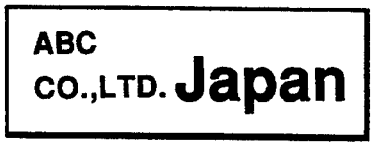
FIG.12B
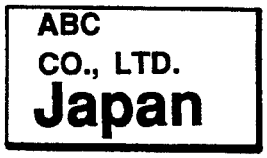
FIG.12C
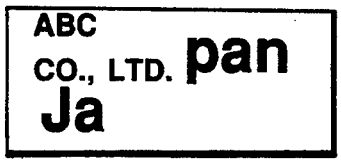
FIG.12D
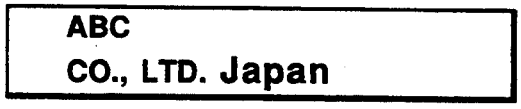
FIG.12E
FIG.14A
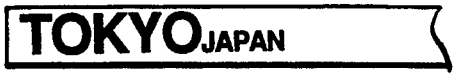
FIG.14B
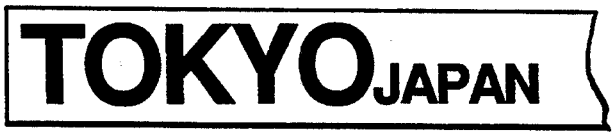

| TAPE WIDTH | SWX | SWY | SWZ | DIGITAL VALUE |
|---|---|---|---|---|
| 6mm | OFF | OFF | OFF | 000 |
| 7mm | OFF | OFF | ON | 001 |
| 8mm | OFF | ON | OFF | 010 |
| ⋮ | ⋮ | ⋮ | ⋮ | ⋮ |
| 13mm | ON | ON | ON | 111 |

FIG.16

TAPE PRINTER APPARATUS

BACKGROUND OF THE INVENTION

1. Field of the Invention

The present invention relates to a tape printer apparatus in which a plurality of tape cassettes containing tapes of different widths are selectively mounted, and printing is effected on the tapes contained in the mounted tape cassette.

2. Description of the Related Art

Tape printer apparatuses, as disclosed in European Patent Applications 0451830A2, 0322918A2 and 0449465A, have been manufactured, wherein key-input information is printed on a tape with an adhesive, the tape is cut to a predetermined length, and the tape is adhered.

In such printer apparatuses, tapes are contained in cassette cases, and a cassette case mounted in the apparatus is exchanged with another one to exchange easily a tape used in the apparatus with another tape.

There is also a printer apparatus having a plurality of tape cassettes containing tapes of different widths so that tapes of various widths can be used in the apparatus by selectively mounting the tape cassettes in the apparatus.

In the apparatus capable of using tapes of various widths, it is troublesome to set a printing size such that printed characters are located within the width of the selected tape.

The applicant paid attention to the fact that the thickness of a tape cassette varies in accordance with the width of a tape to be contained in the tape cassette, and invented a technique of detecting the width of a tape contained in the tape cassette by detecting the thickness of the tape cassette. This invention has been filed with the U.S. Patent & Trademark Office as U.S. Serial No. 07/820,574 (abandoned in favor or Ser. No. 08/014,097, now U.S. Pat. No. 5,253,334.

In the case of detecting the tape width on the basis of the thickness of the tape cassette, there is a problem that the same number of cassette cases as the number of tape widths must be provided.

In addition, in the former application, a switch for detecting the thickness of the cassette case in an analog manner is employed to reduce the number of switches to one. If the switch for detecting the thickness in an analog manner is used, the structure of the apparatus and circuit configurations become complex.

SUMMARY OF THE INVENTION

The object of the present invention is to provide a tape printer apparatus in which at least one of tape cassettes containing tape members of different widths is mounted, the tape printer apparatus being capable of detecting the width of the tape member contained in the tape cassette mounted in a cassette mounting portion, with a simple structure and circuit configuration, and performing a printing matching with the tape width.

In order to achieve this object, there is provided a tape printer apparatus in which at least one of tape cassettes containing tape members of different widths is mounted, the tap cassettes having notches indicating the widths of the tape members, the tape printer apparatus comprising: a device case provided with a cassette mounting portion in which at least one of the tape cassettes is mounted; printing data input means for inputting data to be printed; printing means for printing the input printing data on the tape member of the tape cassette mounted in the cassette mounting portion; switch means being turned on or off in accordance with the presence or absence of the notch of the cassette case mounted in the cassette mounting portion; and control means for controlling a printing action of the printing means in accordance with the on or off state of the switch means.

According to the above structure, the width of the tape can be detected with the simple structure and circuit configuration even if the number of tapes of various widths are used, and it is possible to prevent printing of data outside the tape. In addition, a decrease in life of a printing head due to a printing error can be prevented, and the user need not do complicated operations in order to prevent a printing error. Furthermore, since the width of the tape contained in the cassette case is detected by use of the notch formed in the cassette case, cassette cases of the same thickness can be used for containing tapes of different widths.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 5B shows a data memorizing state of a printing data memory portion shown in the block diagram of FIG. 5A;

FIG. 6 is a table showing a relationship between switches provided in the tape printer apparatus shown in FIG. 1 and cassettes;

FIGS. 11A, 11B, 11C, 11D and 11E show examples of display images obtained when a process shown in FIG. 10 has been performed;

FIGS. 12A, 12B, 12C, 12D and 12E show printed tapes obtained when the data shown in FIGS. 11A to 11E is displayed on a display unit;

FIGS. 14A and 14B show examples of printed tapes obtained in the character size automatic setting mode illustrated in FIG. 13;

FIG. 16 is a table showing the relationship between the cassettes and the switches provided in the tape printer apparatus according to the embodiment shown in FIGS. 15A to 15E.

DETAILED DESCRIPTION OF THE PREFERRED EMBODIMENTS

An embodiment of the present invention will now be described with reference to the accompanying drawings.

FIG. 1 to FIG. 14 show a tape printer apparatus according to an embodiment of the invention.

Figure 1:
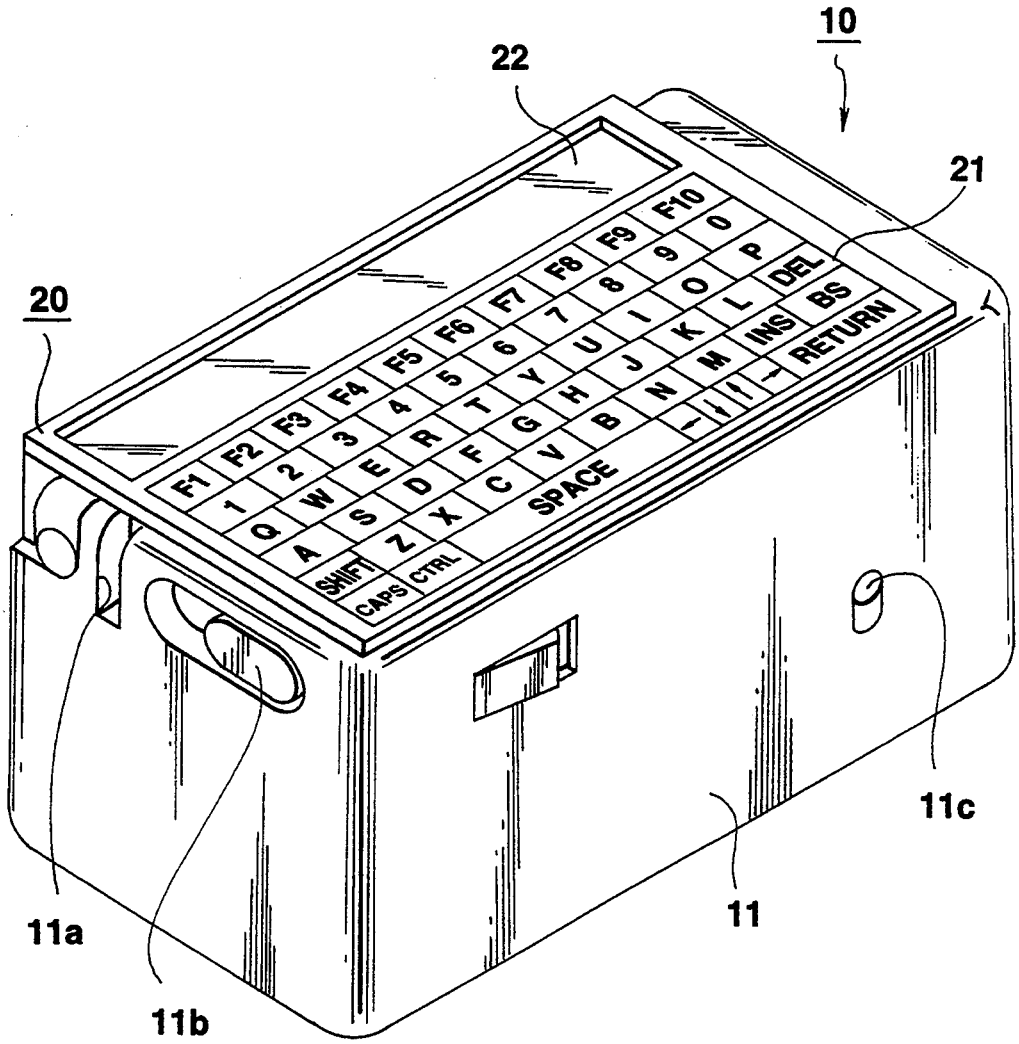
FIG. 1 is a perspective view showing an external appearance of a tape printer apparatus according to an embodiment of the present invention.
Figure 2:
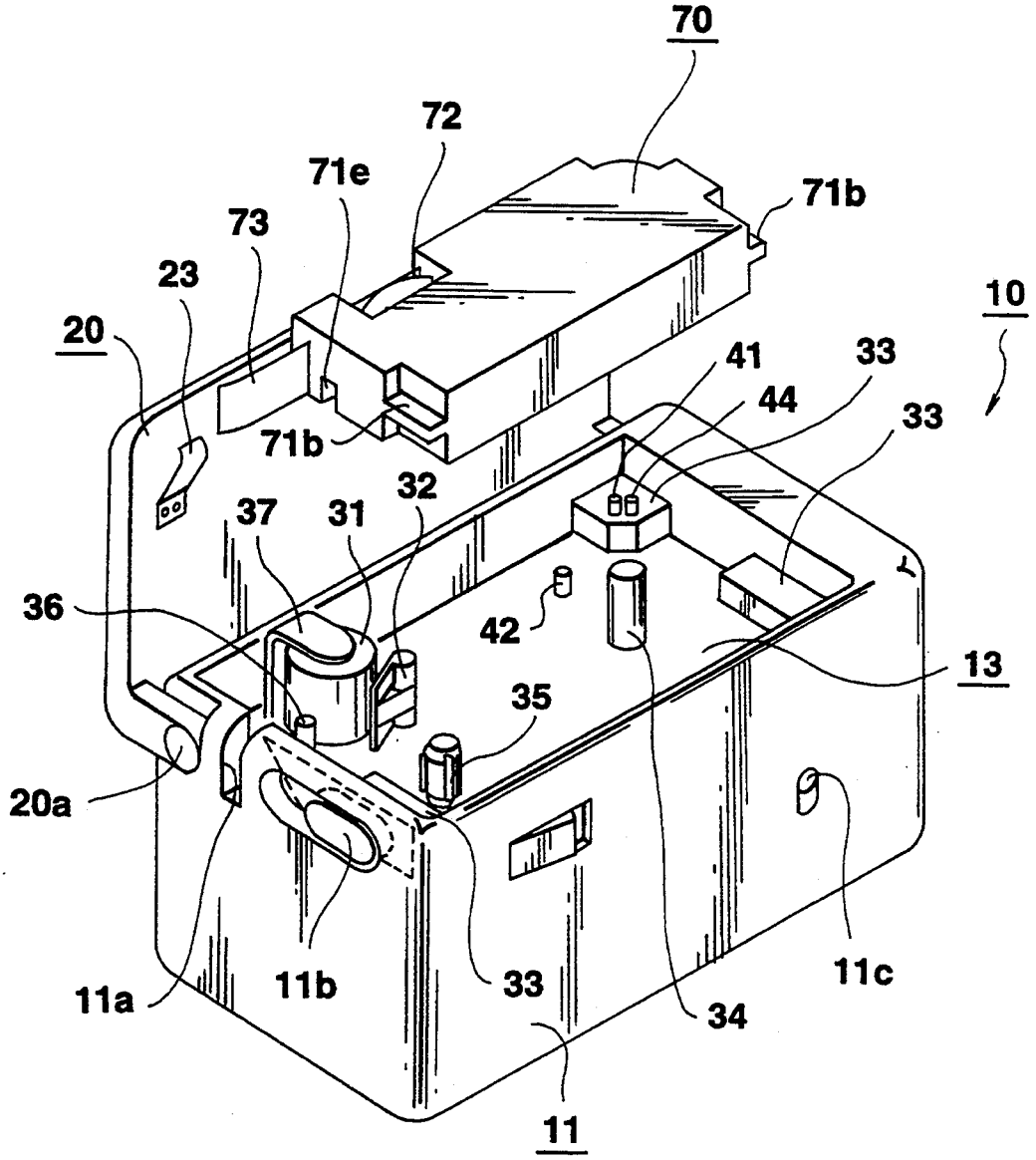
FIG. 2 is a perspective view showing a state in which a cover of the tape printer apparatus shown in FIG. 1 is opened.

In FIGS. 1 and 2, reference numeral 10 denotes a thermal transfer type tape printer apparatus, and numeral 70 denotes a tape cassette.

The tape printer apparatus has a cubic shape, being of handy-sized proportions (w:190 mm×D:120 mm×H:60 mm).

The tape cassette 70 is detachably mounted on a cassette mounting portion (described later) of the tape printer apparatus 10.

Figure 3:
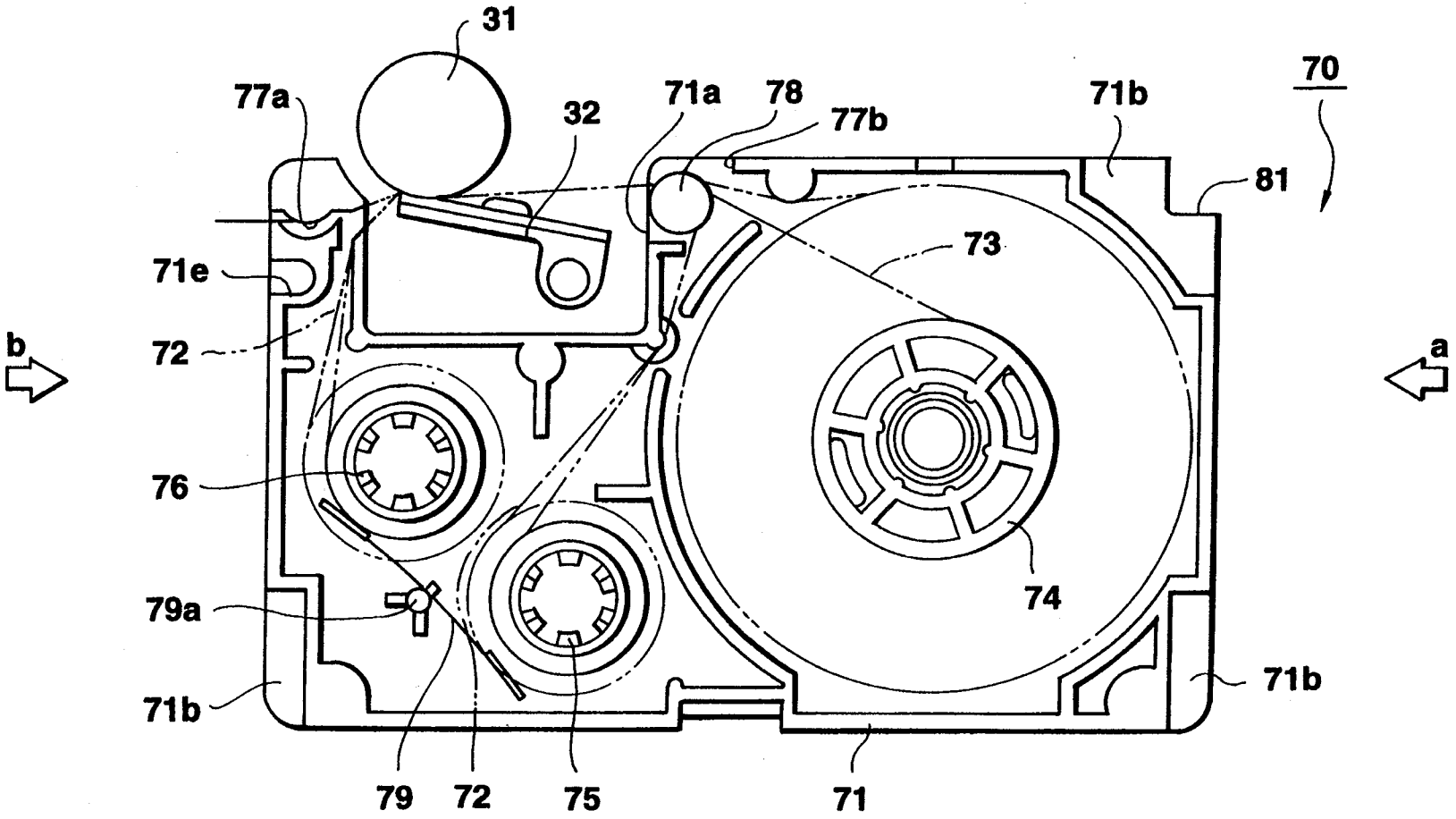
FIG. 3 is a horizontal cross-sectional view of a tape cassette to be mounted in the tape printing apparatus shown in FIG. 1.

As is shown in FIG. 3 in detail, as regards the tape cassette 70, a hollow rectangular-parallelepipedic cassette case 71 contains an ink ribbon 72 and a printing tape 73.

The tape cassettes used in this embodiment are, as shown in FIG. 6, a tape cassette 70A containing a tape **73*a* having a width of 6 mm (hereinafter referred to as "6 mm-width tape cassette"), a tape cassette 70B containing a tape 73*b* having a width of 9 mm ("9 mm-width tape cassette"), a tape cassette 70C containing a tape 73C having a width of 12 mm ("12 mm-width tape cassette"), and a tape cassette 70D containing a tape 73*d*** having a width 18 mm ("18 mm-width tape cassette").

Figure 4A:
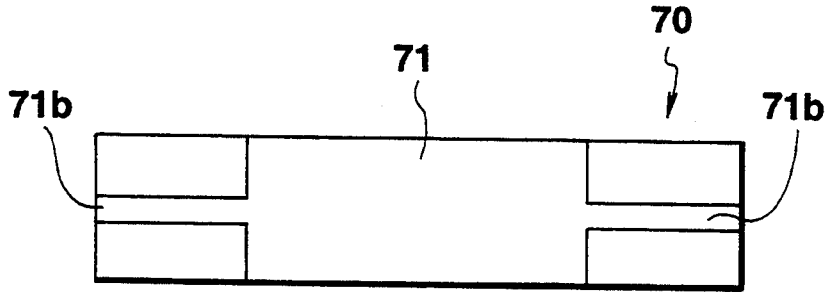
FIG. 4A is a side view, taken in the direction of arrow "a" in FIG. 3.
Figure 4B:
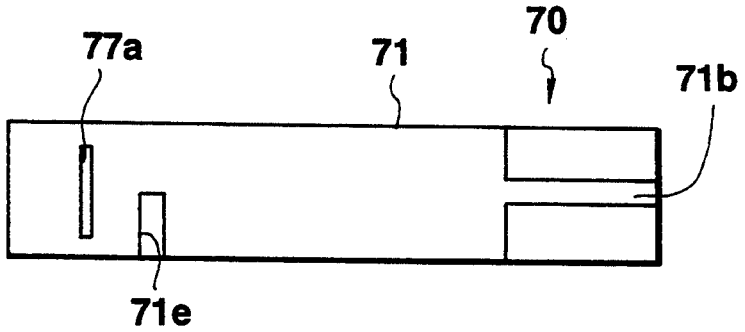
FIG. 4B is a side view, taken in the direction of arrow "b" in FIG. 3.

Each of the cassette cases 71 constituting main bodies of the tape cassettes 70A, 70B, 70C and 70D is formed by coupling an upper half member and a lower half member to make a hollow rectangular-parallelepipedic shape, as shown in FIGS. 3 and 4. A notch **71*a* having a rectangular shape, when viewed from above, is formed at one side portion of the cassette case 71, and a tape discharge port 77*a* and a tape feed-out port 77*b* are formed on both left and right sides of the notch 71*a***.

As will be described later, the notch **71*a* is located at a position corresponding to a platen roller 31 and a thermal head 32. When the tape cassette 70 is mounted in a cassette mounting portion 13, the platen roller 31 and thermal head 32 are located within the notch 71*a***.

The tape discharge port **77*a* and tape feed-out port 77*b* are opened on both left and right sides of the notch 71*a*, and a guide roller 78 is disposed in the tape feed-out port 77*b*. The tape discharge port 77*a* is located in a position corresponding to a tape discharge port 11*a* (described later) of a case body 11 of the tape printer apparatus 10. In a state in which the tape cassette 70 is mounted, the tape discharge port 77*a* is open to face the tape discharge port 1 is so as to communicate the notch 71*a* with the tape discharge port 11*a* such that the printing tape 73 can pass there through. As is shown in FIG. 3, the printing tape 73 is passed over the guide roller 78 and guided to the notch 71*a***.

Figure 7:
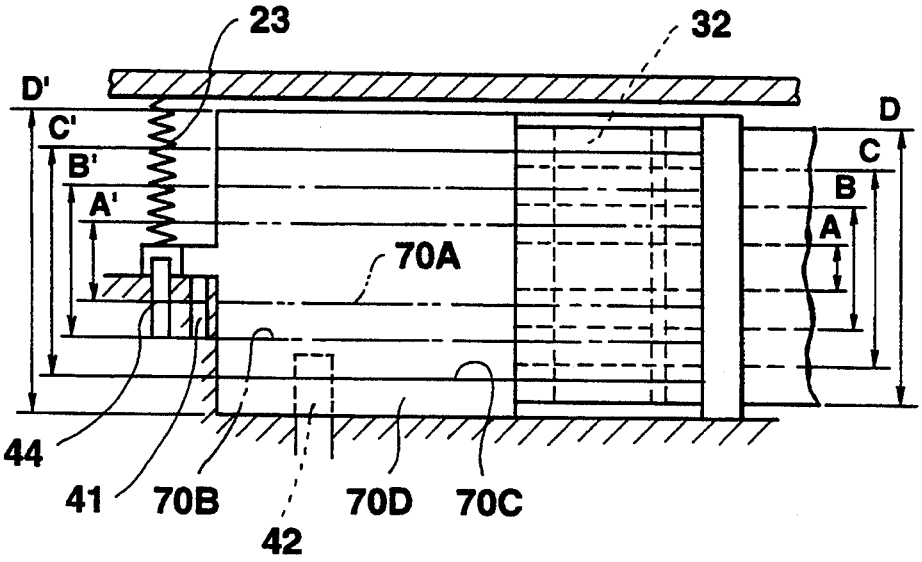
FIG. 7 shows a relationship between cassettes mounted in the tape printer apparatus shown in FIG. 1 and tapes within the cassettes.
Figure 8:
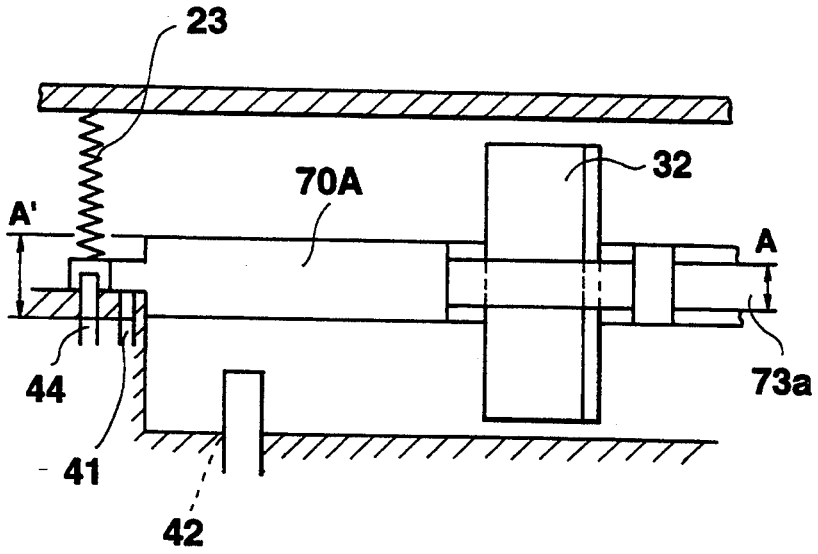
FIG. 8 is an enlarged view of a main portion of the tape printer apparatus shown in FIG. 1, in which a tape cassette containing a tape of a smallest width is mounted in the apparatus.
Figure 9:
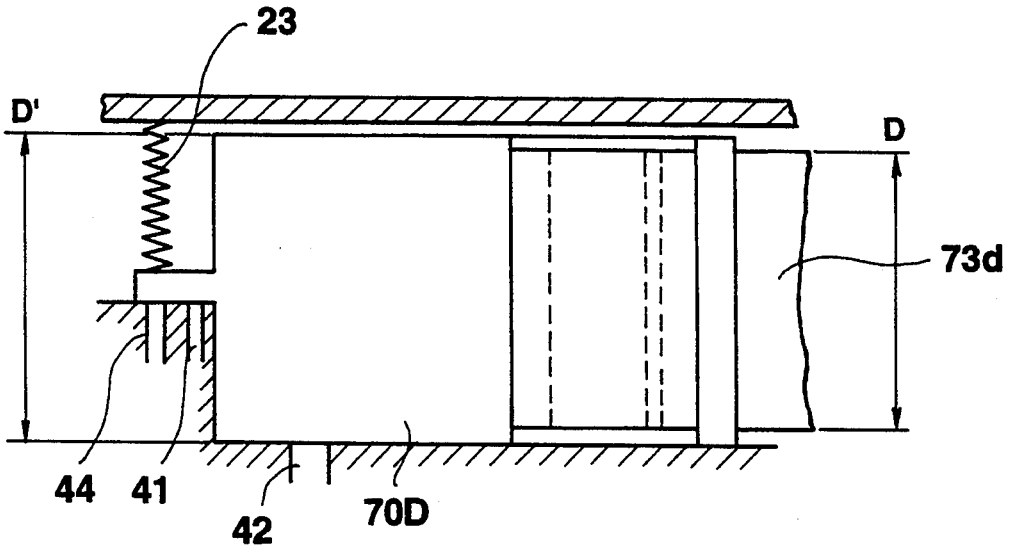
FIG. 9 is an enlarged view of a main portion of the tape printer apparatus shown in FIG. 1, in which a tape cassette containing a tape of a largest width is mounted in the apparatus.

Top and bottom surfaces of three corners of the cassette case 71 are cut out to provide three flat positioning portions **71*b*. These positioning portions 71*b* are located in positions corresponding to placement portions 33 of the cassette mounting portion 13 (described later). As is shown in FIGS. 7 and 8, when the cassette case 71 is mounted, a bottom surface of each positioning portion 71*b* contacts the corresponding placement portion 33, thereby determining amounting position (in particular, vertical position) of the cassette case 71. The positioning portions 71*b* are formed such that even if any of the tape cassettes 70A, 70B, 70C and 70D is mounted in the cassette mounting portion 13**, a center position of each tape in its width direction is identical.

A notch 81 (identification portion) is formed at the positioning portions **71*b* of the 6 mm-width tape cassette 70A and 12 mm-width tape cassette 70C, among the 6 mm-width tape cassette 70A, 9 mm-width tape cassette 70B, 12 mm-width tape cassette 70C and 18 mm-width tape cassette 70D (see FIG. 6**).

Further, the cassette case 71 is provided with a tape supply spool 74 (on a right side within the case 71 in FIG. 3), an ink ribbon supply spool 75 (on a left side within the case 71),and an ink ribbon take-up spool 76 (on the left side within the case 71). These spools are rotatable. The tape supply spool 74 is rotatably fitted on a spool shaft 34 (FIG. 2), and the ink ribbon take-up spool 76 is engageably fitted on an ink ribbon take-up shaft 35 (FIG. 2). In these spools 74 and 76, the ink ribbon take-up spool 76 is rotated by the shaft 35.

The tape 73 is wound around the tape supply spool 74, and the ink ribbon 72 is wound around the ink ribbon supply spool 75. The ink ribbon 72 is passed from the supply spool 75 to the ink ribbon take-up spool 76.

Specifically, the 6 mm-width tape cassette 70A contains an ink ribbon **72*a* having the same width as the 6 mm-width tape 73*a*. The 9 mm-width tape cassette 70B contains an ink ribbon 72*b* having the same width as the 9 mm-width tape 73*b*. The 12 mm-width tape cassette 70C contains an ink ribbon 72*c* having the same width as the 12 mm-width tape 73*c*. The 18 mm-width tape cassette 70D contains an ink ribbon 72*d* having the same width as the 18 mm-width tape 73*d***.

Although not illustrated, the tape 73 is constructed such that peeling paper is laminated on a tape base material with an adhesive layer being interposed therebetween. The ink ribbon 72 is impregnated with a hot-melt ink or a hot-subliminal ink. Since the structures of these label tape 73 and ink ribbon 72 are well known, a detailed description thereof is omitted.

In FIG. 3, reference numeral **71*e* denotes a positioning recess, and 79 denotes a tape holder. The positioning recess 71*e* engages with an engaging projection (not shown) of the case body 11 when the tape cassette is mounted, thereby positioning the tape cassette. The tape holder 79 is constructed by a plate spring a center portion of which is supported by the cassette case 71. Both end portions of the plate spring slidably contacts the ink ribbon 72 both end portions of which are wound around the spools 75 and 76, thus preventing the ink ribbon 72** from being entangled.

The tape printer apparatus 10 has a handy-sized rectangular parallelepipedic body case 11. As is shown in FIGS. 1 and 2, the cassette mounting portion 13 which can be opened and closed by a cover 20 is formed in an upper portion of the body case 11 to be able to hold the tape cassette 70. The tape discharge port 11*a* and a cutter button 11*b* are provided on a left side surface of the body case 11, and a power switch 11*c* is provided on a right side surface of the case 11. The printed label tape 73 is discharged from the label discharge port 11*a*, and the label tape 73 is cut by the operation of the cutter button 11*b*.

The case cover 20 is supported on the body case 11 by means of a hinge, etc. (not shown) such that it can open in one direction. Atop surface of the cover 20 is provided with a key input portion 21 and a display portion 22, and a bottom surface thereof is provided with a plate spring 23 for holding the cassette. The plate spring 23 resiliently contacts the tape cassette 70 when the case cover 20 closes the cassette mounting portion 13. Thus, the plate spring 23 urges the tape cassette 70 towards a bottom of the cassette mounting portion 13 and holds the tape cassette 70 therein (see FIGS. 7 and 8).

The key input portion 21 is provided with character input keys, an indent keys etc. for effecting word processor functions for producing character sequence data such as data print names, headings, indexings, as well as a print character size selection key, a key for designating the number of print lines, etc. The display portion 22 displays character sequences or message data obtained by the key input operations in accordance with the associated processing. Each key of the key input portion 21 and the display portion 22 are connected to a controller circuit 50 within the body case 11 through wiring such as heat seal (not shown).

The cassette mounting portion 13 of the case body 11 is constructed by a substantially rectangular parallelepipedic space with an upper part thereof being opened, and, as has been described above, the upper opening is opened and closed by the case cover 20. On the bottom surface of the cassette mounting portion 13, a platen roller 31 and a thermal head 32 are arranged near one corner of the bottom surface, and the placement portions 33 are arranged at the other three corners of the bottom surface. In addition, the spool shaft 34 and the ribbon take-up shaft 35 are disposed in the bottom surface with a predetermined distance therebetween.

The spool shaft 34 projects so as to be engageable with the tape supply spool 74 within tape cassette 70. Similarly, the ribbon take-up shaft 35 projects so as to be engageable with the ink ribbon take-up spool 76. The ribbon take-up shaft 35 is coupled to a driving mechanism (not shown) within the case body 11. When the tape cassette 70 is mounted in the cassette mounting portion 13, the ribbon take-up shaft 35 enters into the spool 76 from the bottom surface of the tape cassette 70 and engages with the spool 76, thereby driving the spool 76 to wind up the tape.

An upper end of the platen roller 31 is held by a bracket 37 so that the platen roller 31 is rotatable about an axis vertical to the bottom surface of the cassette mounting portion 13. A lower end portion of the platen roller 31 is coupled to a driving mechanism (not shown) within the case body 11. The platen roller 31 is driven and rotated at the time of effecting printing on the label tape 73.

The thermal head 32 is disposed on the bottom surface of the cassette mounting portion 13 so as to be in parallel with the rotational axis of the platen roller 31, and is urged by a torsion spring, etc. (not shown) so that the head 32 come into contact with the platen roller 31.

As is well known, the thermal head 32 has a number of regularly arranged heating elements, and these heating elements are connected to a printing portion 56 of the control circuit 50 within the case body 11. At the time of printing, the heating elements are activated in accordance with printing data.

Each placement portion 33 is formed on the bottom surface of the cassette mounting portion 13. As will be described later, when the tape cassette 70 is mounted, the placement portions 33 engage with the positioning portions 71 of the tape cassette 70, thereby determining the mounting position of the tape cassette 70.

One of the placement portions 33 (the upper right one in FIG. 2) is provided with a cassette presence/absence detection switch 41 (SW1). The detection switch 41 (SW1) is connected to the control circuit 50. The switch 41 (SW1) is constructed by a mechanical switch such as a micro-switch. When the tape cassette 70 is mounted, the switch 41 (SW1) is turned on, and when the tape cassette 70 is demounted, it is turned off. Thereby, the mounting and the demounting of the tape cassette 70 is detected, and an obtained detection signal is output to the control circuit 50.

A first cassette discrimination switch 42 (SW2) for discriminating the mounted tape cassette 70 is provided on the bottom surface of the cassette mounting portion 13. The first cassette discrimination switch 42, too, is constructed by a micro-switch, etc. and is connected to the control circuit 50. A detector provided on the discrimination switch 42 (SW2) projects at a predetermined height from the bottom surface of the cassette mounting portion 13.

As shown in FIG. 7, the 6 mm-width tape cassette 70A and 9 mm-width tape cassette 70B have such dimensions A′ and B′ between the positioning portion 71*b* and the bottom surface thereof, that the first cassette discrimination switch 42 does not operate. The 12 mm-width tape cassette 70C and 18 mm-width tape cassette 70D have such dimensions C′ and D′ between the positioning portion 71*b* and the bottom surface thereof, that the cassette width discrimination switch 42 is operated when the tape cassettes are mounted.

Accordingly, the first cassette discrimination switch 42 (SW2) is normally turned off, and it is turned on only when the 12 mm-width tape cassette 70C or 18 mm-width tape cassette 70D are mounted. An obtained detection signal is output to the control circuit 50.

As is shown in FIG. 2, in the cassette mounting portion 13 of the tape printer apparatus 10, a second cassette discrimination switch 44 (SW3) is provided on the placement portion 33, in addition to the first cassette discrimination switch 42 (SW2) provided on the bottom surface of the cassette mounting portion 13.

Accordingly, the second cassette discrimination switch 44 (SW3) and the cassette presence/absence detecting switch 41 (SW1) are juxtaposed on the placement portion 33.

Like the switches 41 and 42, the second cassette discrimination switch 44 is connected to a switch detector 55 of the controller circuit 50.

The second cassette discrimination switch 44 (SW3) corresponds to the notch formed in the positioning portion 71*b* of the 6 mm-width tape cassette 70A and 12 mm-width tape cassette 70C.

As is shown in FIG. 6, when the 6 mm-width tape cassette 70A or 12 mm-width tape cassette C is mounted in the mounting portion 13, the second cassette discrimination switch 44 (SW3) is turned off, and when the 9 mm-width tape cassette 70B or 18 mm-width tape cassette D is mounted in the mounting portion 13, the switch 44 (SW3) is turned on.

Accordingly, as is shown in FIG. 6, the switches 41, 42 and 44 are selectively turned on in accordance with the cassette width of the tape cassettes 70A, 70B, 70C and 70D mounted within the cassette mounting portion 13.

Specifically, as shown in FIG. 6, when the 6 mm-width tape cassette 70A is mounted in the cassette mounting portion 13, the cassette presence/absence detection switch 41 (SW1) is turned on. When the 9 mm-width tape cassette 70B is mounted, the cassette presence/absence detection switch 41 (SW1) and the second cassette discrimination switch 44 (SW3) are turned on. When the 12 mm-width tape cassette 70C is mounted, the cassette presence/absence detection switch 41 (SW1) and the first cassette discrimination switch 42 (SW2) are turned on. When the 18 mm-width tape cassette 70D is mounted, all switches 41 (SW1), 42 (SW2) and 44 (SW3) are turned on.

Therefore, outputs from the switches 41 (SW1), 42 (SW2) and 44 (SW3) are input to the switch detector 55 of the control circuit 50, and the switch detector 55 outputs a 3-bit digital signal corresponding to the switching states of the switches 41, 42 and 44, to a control portion 51.

Accordingly, based on the 3-bit digital signal, the control circuit 51 determines the presence or absence of the cassette, and the Cassette width of the tape cassette 70, i.e. the width of the tape 73 contained therein.

Although not shown in FIG. 2, the cassette mounting portion 13 is provided with an ink color detection switch 45 (see FIG. 5). The ink color detection switch 45 is constructed by a groove detection movable plate, which is fitted in a color discrimination groove formed in each tape cassette 70 with a different depth in accordance with the color of the ribbon, and a microswitch for detecting a positional movement of the groove detection movable plate. The ink color detection switch 45 is connected to the control circuit 50 and outputs a detection signal.

Figure 5A:
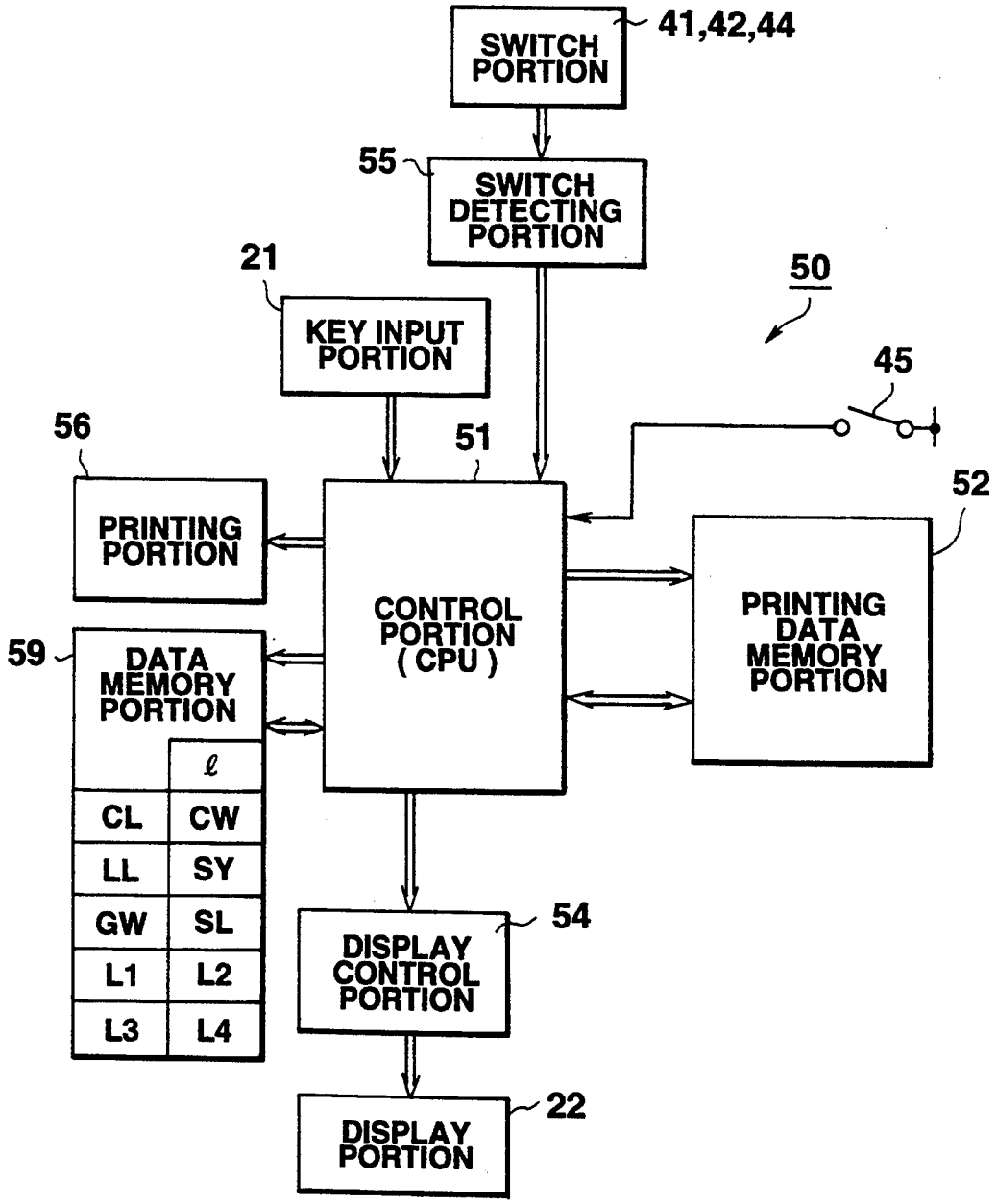
FIG. 5A is a block diagram of an internal control circuit of the tape printer apparatus shown in FIG. 1.

Referring to FIG. 5A, the entire circuit configuration of the tape printer apparatus will now be described.

The control circuit 50 has a control portion 51 constructed by a CPU, etc., as shown in FIG. 5A. The control portion 51 is connected to the aforementioned key input portion 21 and a printing data memory portion 52 for storing a produced printing character sequence. In addition, the control portion 51 is connected to the display portion 22 via a layout display control portion 53 and a display control portion 54.

The printing data memory portion 52 stores input character data as well as input character size data.

Furthermore, the printing data memory portion 52 stores a stop code (STOP) at the end of the printing character sequence.

The character size data is constructed by a length-directional character size X and a width-directional character size Y. In this embodiment, the character size is expressed as a length-directional character size X and a width-directional character size Y.

Each of the length-directional character size X and the width-directional character size Y can take a value of 1 to 4. Therefore, the number of character sizes is 16, i.e. [1, 1], [1, 2], [1, 3], [1, 4], [2, 1], . . . , [4, 3], [4, 4].

In this embodiment, the printing space of the 16 character sizes is set such that [1] is 4 mm.

Specifically, the printing space of character size [1×1] is 4 mm (length)×4 mm (width). The printing space of the character size [2×2] is 8 mm×8 mm. The printing space of the character size [2×3] is 8 mm×12 mm.

The printing character sequence stored in the printing data memory portion 52 is successively read out by the control portion 51 in accordance with the setting of the printing mode, and the read-out character sequence is supplied to the display control portion 54 and displayed on the display portion 22.

The control portion 51 supplies to the display control portion 54 the printing character sequence read out from the printing data memory portion 52 as well as setting information of printing format consisting of a character size, a maximum printing length, a width of an used tape, and a printing image of a character designated by a cursor among the displayed printing character sequences. These are displayed on the display portion 22.

Besides, a switch portion including the aforementioned cassette presence/absence detection switch 41 and the first and second cassette discrimination switches 42, 44 are connected to the control portion 51 via the switch detecting portion 55. Further, the control portion 51 is connected to the ink color detection switch 45, a printing portion 56 and the data memory portion 59.

As has been described above, the cassette presence/absence detection switch 41 and the first and second cassette discrimination switches 42 and 44 output high-level signals in their on-state and low-level signals in their off-state. The switch detecting portion 55 outputs, as a 3-bit digital signal, the output signal of each of the switches 41, 42 and 43, and inputs this digital signal to the control portion 51.

The printing portion 56 includes a thermal head driving circuit (not shown) which controls heating operation of the thermal head 32 on the basis of the control signal input from the control portion 51. The printing portion 56 performs a printing process of the printing character sequences successively read out from the printing data memory portion 52, in accordance with predetermined printing format information. Furthermore, the printing portion 56 controls the rotation of the ribbon take-up driving shaft 35 and the platen roller 31.

The data memory portion 59 comprises a line register I for storing the line of character data being read out, a character printing length register CL for storing the printing length of one character read out from the data memory portion 52, a character printing width register CW for storing the printing length of the one character in the width-direction, a line printing length register LL for storing the printing length of the line being read out, a line width-directional character size register SY for storing a maximum one of the width-directional character sizes of characters in the line being read out, a sum printing width register GW for storing the printing width of one label, maximum width-directional character size memory portions L1 to L4 for storing maximum width-directional character size of characters in the first to fourth lines, and a maximum printing length register SL for storing a maximum line printing length in the first to fourth lines.

When character data is input from the key input portion 21, the input character data is stored in the printing data memory portion 52 via the control portion 51. When a new-paragraph command is input by the key input portion 21 before character data ends, the control portion 51 memorizes a new-paragraph code (LF) at a point in the character data. When a print interrupt command is input to suspend the printing action, a print interrupt code (STOP) is memorized at the end of the character data.

In addition, in the key input portion 21, when the character size is designated, the control portion 50 stores the character size data as well as each character data in the printing data memory portion 52.

FIG. 5B shows an example of the data storage state of the printing data memory portion 52. The printing data memory portion 52 stores two-line printing character sequences "ABC/CO., LTD/Japan" comprising the first line of "ABC" of character size [1×1] and the second line of "CO.,LTD" of character size [1×1] and "Japan" of character size [2×2].

The action of the above embodiment will now be described.

Figure 10:
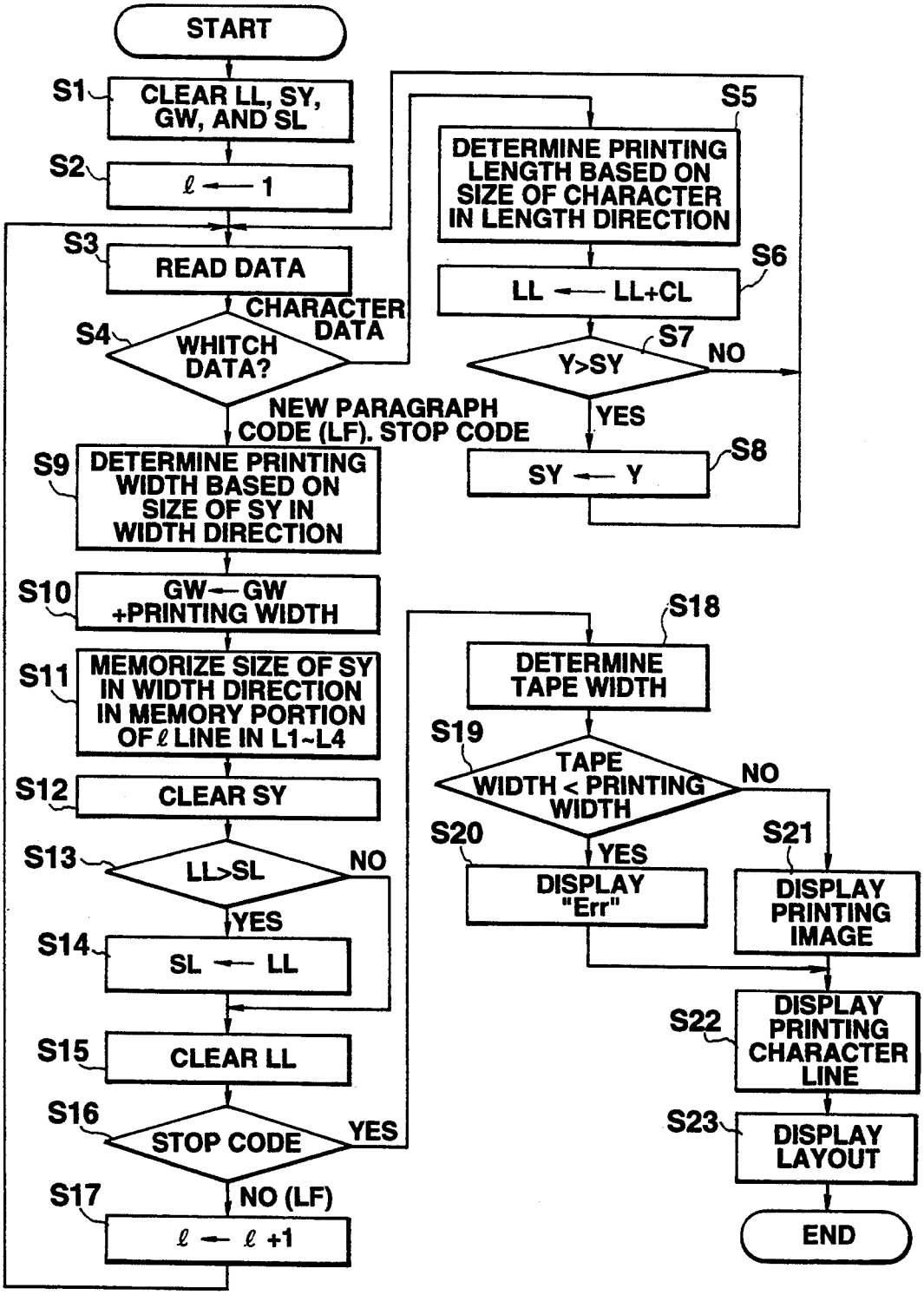
FIG. 10 is a flow chart for illustrating an action in a printing mode of a control circuit shown in FIG. 5A.

In this embodiment, the process illustrated in FIG. 10 is executed in the control portion 51, and the printing on the tape 73 is controlled.

In the following, it will be explained that, for example a printing character sequence of "ABC CO., Japan" shown in FIG. 11 is printed on the 18 mm-width tape **73*d* or 9 mm-width tape 73*b***.

Suppose that the printing character sequence "ABC CO., LTD. Japan" is stored in the printing data memory portion 52 as a non-paragraphed character sequence with the character size [1×1] for "ABC CO., LTD." and the character size [2×2] for "Japan", and that the 18 mm-width tape cassette 70D is mounted in the cassette mounting portion 13.

When a mode switch key of the key input portion 21 is operated to select a printing mode, an action illustrated by a flow chart in FIG. 10 begins.

In step S1, the control portion 51 clears the line printing length register LL, line maximum width-directional character size register SY, sum printing width register GW and maximum printing length register SL of the data memory portion 59. In step S2, "1" is set in the line register I. In step S3, the control portion 51 reads out a top data in the printing data memory portion 52, and it is determined whether the data read out in step S3 is character data, new-paragraph code (LF) or printing interrupt code (STOP).

In the present case, the top data is a character data of "A". Thus, in step S4, the top data is determined as a character data, and the control routine goes to step S5.

In step S5, the printing length of the character is obtained from a length-directional size X of a character size data stored in the printing data memory portion 52 along with the character data "A". The obtained printing length is stored in the character printing length register CL.

In this case, since the character size of the character data "A" is [1×1], the length-directional character size is [1] and the printing length is 4 mm.

The printing length obtained in step S5 is added to the line printing length register LL of the data memory portion 59 in step S6.

In step S7, it is determined whether a width-directional character size Y of the read-out character data is greater than the maximum width-directional character size stored in the maximum line width-directional character size register SY of the data memory portion 59 or not. If "YES" in step S7, the control routine advances to step S8, and the width-directional character size Y of the character size is stored in the line maximum width-directional character size register SY.

Since the first character is processed in this case, the line maximum width-directional character size register SY has been cleared, and "YES" is determined in step S7, the control routine advances to step S8, and the width-directional character size of the character data, i.e. [1], is stored in the line maximum width-directional character size register SY.

When the process of the first character in the printing character sequence in steps S5 to S8 is finished, the control routine returns to step S3. Then, a data of the second character "B" and subsequent characters in the printing character sequence is successively read out, and the process of steps S4 to S8 is repeated. Thereby, the printing length data (10 cm in this case) of one line of the printing character sequence "ABC CO., LTD. Japan" is stored in the line printing length register LL of the data memory portion 59, and the maximum width-directional character size (size [2] in this case) is stored in the line maximum width-directional character size register SY of the data memory portion 59.

Returning to step S3, the stop code (STOP) indicating the end of the printing character sequence "ABC CO., LTD. Japan" is read out from the printing data memory portion 52, and the control routine advances to step S4.

In step S4, the read data is determined as the stop code (STOP), and the control routine goes to step S9.

In step S9, a printing width is obtained from the maximum width-directional character size stored in the line maximum width-directional character size register SY, and the obtained printing width is stored in the sum printing width register GW. In this case, since the maximum width-directional character size is [2], the printing width is 8 mm and "8 mm" is added to the sum printing width register The control routine advances to step S11, and the maximum width-directional character size stored in the line maximum width-directional character size register SY is memorized in one of the maximum width-directional character size memory portions L1 to L4, which corresponds to the line designated by the line register I. In this case, since I is the first line, [2] is stored in the maximum width-directional character size memory portion L1 corresponding to the first line.

Then, the control routine goes to step S12, and the line maximum width-directional character size register SY is cleared.

The control routine advances to step S13. When the number of the printing character line for one label is plural, the maximum printing length stored in the maximum printing length register SL of the data memory portion 59 is compared with the printing length stored in step S6 in the printing length register LL, and the greater one is stored in the maximum printing length register SL. When the character sequence consists of only one line, the printing length of the printing length memory register LL is stored unconditionally in the maximum printing length memory register SY.

Then, in step S13, the printing length stored in the printing length register is cleared.

If the data read out in step S3 is the stop code (STOP), this means that the read-out of the printing character sequence for one label has been completed and the sum printing width data, the maximum character size data of each line and the maximum printing length data have been obtained. In step S16, it is determined that the read-out of the printing character sequence for one label has been completed, and the control routine goes to step S18.

In step S18, it is determined which one of the tape cassette 70A, 70B, 70C and 70D is the tape cassette 70 mounted in the cassette mounting portion 13. That is, the tape width is discriminated. In this case, since the 18 mm-width tape cassette 70D is mounted, the cassette presence/absence detection switch 41 is turned on and also the first and second cassette discrimination switches 42 and 44 are turned on. And, since the 3-bit signal of "1, 1, 1" is input from the switch detecting portion 55 to the control portion 51, the tape width is determined as 18 mm.

In step S19, the determined tape width (18 mm in this case) is compared with the sum printing width data (8 mm in this case) stored in the sum printing width register GW of the data memory portion 59 in step S10.

Since the printing width (8 mm) of the printing character sequence is less than the width (18 mm) of the tape 73*d*, it is possible to perform the printing conforming to the format set at the time of inputting the printing character sequence. Then, the control routine advances to step S21.

In step S21, the maximum width-directional character size of each line stored in the data memory portion 59 in step S11 (in this case, only [2] is stored in the first-line maximum width-directional character size memory portion) is transferred to the display control portion 54. As shown in FIG. 11A, a right end portion of the upper part of the display portion 22 displays a printing image (in this case, only one line) in which a line including a character of a character size greater than character size [1×1] is indicated by a thick line.

Then, in step S22, printing character sequence "ABC CO., LTD. Japan" is displayed.

In step S23, the display portion 22 displays, from the upper left end, the character size [1×1] corresponding to a cursor-designated character ("A" in this case), the label width (18 mm) of the mounted tape cassette 70D, and the maximum printing length data (10 cm) of the printing character sequence stored in the maximum printing length register of the data memory portion 59.

Specifically, by preparing the printing character sequence "ABC CO., LTD. Japan" and then setting its printing mode, the user can know in advance, on a layout display of the display portion 22, the fact that the printing character sequence including the character of character size [2×2] is to be printed horizontally on the 18 mm-width label tape 73 over the printing length of 10 cm. A label printing process corresponding to the layout display is executed in the printing portion 56 in response to the printing start key operation, and thereby the tape shown in FIG. 12A can be produced.

In an action which will now be described, the mode switch key of the key input portion 21 is operated to select the printing mode in a state in which a printing character sequence "ABC/CO., LTD./Japan", consisting of a first line of "ABC" of Character size [1×1] and a second line of "CO., LTD." of character size [1×1] and "Japan" of character size [2×2], is stored in the printing data memory portion 52.

Like the above-described case, "ABC" of the first line of the printing character sequence is read out from the printing data memory portion 52 one character by one character, and the process of steps S3 to S8 is repeated.

As a result, the printing length data of "ABC" of the first line of the printing character sequence is stored in the line printing length register LL of the data memory portion 59, and the maximum width-directional character size ([1] in this case) is stored in the line maximum width-directional character size register SY of the data memory portion 59.

In step S3, if a new-paragraph code (LF), indicating a new paragraph and memorized next to the first line "ABC" of the printing character sequence, is read out from the printing data memory portion 52, it is determined in step S4 that the new-paragraph code has been read out, and the control routine advances to step S9.

In step S9, the maximum width-directional character size ([1]) of the first line stored in the line maximum width-directional size register SY of the data memory portion 59 is converted to a printing width (4 mm).

In step S10, the control portion 51 adds the printing width obtained in step S9 to the sum printing width register GW of the data memory portion 59.

In step S11, the control portion 51 stores the maximum width-directional character size of the line maximum width-directional character size register SY of the data memory portion 59 into the first-line maximum width-directional character size memory portion L1. In step S12, the data in the line maximum width-directional size register SY is cleared.

In step S13, the control portion 51 determines whether the first-line printing length stored in the line printing length register LL in step S6 is greater than the maximum printing length stored in the maximum printing length register SL of the data memory portion 59 or not. In this case, "YES" is determined in step S13, since the maximum printing length stored in the maximum printing length register SL is 0, and the control routine advances to step S14. The first-line printing length stored in the line printing length register LL is stored in the maximum printing length register SL.

In step S15, the data in the line printing length register LL is cleared.

In step S16, since the read-out data is the new-paragraph code, it is determined that the read-out data is not the stop code. In subsequent step S17, the line register is incremented by +1, and the control routine returns to step S3.

The data of the second line "CO., LTD. Japan" of the printing character sequence is read out one character by one character, similarly with the above case, and the process of steps S3 to S8 is executed. A printing length data of the second line is stored in the line printing length register LL of the data memory portion 59, and the maximum width-directional character size ([2] in this case) is stored in the line maximum width-directional character size register SY.

In step S3, the stop code (STOP) indicating the end of the two-line printing character sequence "ABC/CO., LTD. Japan" is read out from the printing data memory portion 52, and the control routine goes to step S9.

In step S9, a printing width (8 mm) is obtained in accordance with the second-line maximum width-directional character size ([2]) stored in the line maximum width-directional character size register SY of the data memory portion 59. In step S10, the obtained printing length data is added to the sum printing width memory register GW of the data memory portion 59.

In step S11, [2] is stored in the second-line maximum width-directional character size memory portion. In step S12, the second-line maximum width-directional character size stored in the line maximum width-directional character size register SY is cleared.

In step S13, it is determined whether the second-line printing length stored in the line printing length register LL in step S6 is greater than the maximum printing length (the first-line printing length in this case) stored in the maximum printing length register SL or not.

In this case, since the second-line printing length stored in the line printing length register LL is greater than the first-line printing length stored in the maximum printing length register SL, the second-line printing length stored in the line printing length register LL is stored in the maximum printing length register SL.

In step S15, the second-line printing length stored in the line printing length register LL is cleared.

At this time, reading out of the printing character sequence for one label is completed, and the sum printing width data (4 mm+8 mm), each-line maximum width-directional character size data (first line: [1]/second line: [2]), and the maximum printing length data (second-line printing length) has been obtained.

Since the next data read is a stop code, the control routine goes to step S18 and the tape width (18 mm in this case) is discriminated.

In step S19, it is determined whether the sum printing width data (in this case, 4 mm+8 mm=12 mm) stored in the sum printing width register GW of the data memory portion 59 is greater than the tape width (18 mm) or not.

In this case, since the sum printing width (in this case, 4 mm+8 mm=12 mm) of the printing character sequence is less than the width (18 mm) of the label tape 73*d*, the label printing conforming to the format set at the time of inputting the printing character sequence is possible, and the control routine goes to step S21.

In step S21, as shown in FIG. 11B, the upper right end area of the display portion 22 displays a printing image including a thin line indicating the first line and a thick line indicating the second line having the character of width-directional character size [2], on the basis of the maximum Width-directional character sizes (first line: [1]/second line: [2]) of the respective lines stored in the width-directional character size memory portions L1 to L4 of the data memory portion 59.

In step S22, the printing character sequence "ABC-/CO., LTD. Japan" is displayed.

In step S23, the display portion 22 displays, from the upper left end thereof, the character size [1×1] corresponding to the cursor-designated character ("C" in this case), the label width (18 mm) of the mounted tape cassette 70D, and the maximum printing length data (7 cm) of the printing character sequence stored in the maximum printing length register SL of the data memory portion 59.

In step S23, the printing character sequence "ABC-/CO., LTD. Japan" is displayed.

Specifically, by preparing the printing character sequence "ABC/CO., LTD. Japan" and then setting a printing mode thereof, the user can know in advance, on the layout display of the display portion 22, the fact that the two-line printing character sequence including the character of character size [2×2] in the second line is to be printed horizontally on the 18 mm-width label tape 73D over the printing length of 7 cm. A printing process corresponding to the layout display is executed in the printing portion 56 in response to the printing start key operation, and thereby the tape shown in FIG. 12B can be produced.

In an action which will now be described, the mode switch key of the key input portion 21 is operated to select the printing mode in a state in which a printing character sequence "ABC/CO., LTD./Japan", consisting of a first line of "ABC" of character size [1×1], a second line of "CO., LTD." of character size [1×1] and a third line of "Japan" of character size [2×2], is stored in the printing data memory portion 52.

After the process of steps S1 to S23 is completed, as shown in FIG. 11C, the upper right end area of the display portion 22 displays a printing image including tune thin lines indicating the first and second lines and one thick line indicating the third line including the character of width-directional character size [2]. In addition, the display portion 22 displays, from the upper left end, the character size [1×1] corresponding to the cursor-designated character ("D" in this case), the tape width (18 mm) of the mounted tape cassette 70D, and the maximum printing length data (4 cm) stored in the maximum printing length register SL of the data memory portion 59.

Specifically, by preparing the printing character sequence "ABC/CO., LTD. Japan" and then setting a printing mode thereof, the user can know in advance, on the layout display of the display portion 22, the fact that the three-line printing character sequence including the character of double size in the third line is to be printed on the 18 mm-width tape 73D over the printing length of 4 cm. A printing process corresponding to the layout display is executed in the printing portion 56 in response to the printing start key operation, and thereby the tape shown in FIG. 12C can be produced.

Further, in an action which will now be described, the tape cassette 70 having the 18 mm-width tape 73 is mounted in the cassette mounting portion 13 and the mode switch key of the key input portion 21 is operated to select the printing mode in a state in which a printing character sequence "ABC/CO., LTD./Ja/pan", consisting of a first line of "ABC" of character size [1×1], a second line of "CO., LTD." of character size [1×1], a third line of "Ja" of character size [2×2], and a fourth line of "pan" of character size [2×2], is stored in the printing data memory portion 52.

Like the above-described case, the process of S1 to S17 is executed.

In step S16, if it is determined that the data read out at this time is the stop code (STOP), it is considered that the read-out of the printing character sequence "ABC-/CO., LTD./Ja/pan" for one label has been completed and the sum printing width data (4 mm+mm+8 mm+8 mm=24 mm), each-line maximum width-directional character size data (first line: [1]/second line: [1]/third line: [2]/fourth line: [2]), and the maximum printing length data (second-line printing length) of the longest print-length line has been obtained.

In step S18, the tape width is discriminated. In this case, like the above, described case, the tape width is determined as 18 mm since the 18 mm-width tape cassette 70D is mounted in the cassette mounting portion 13.

In step S19, it is determined whether the tape width (18 mm in this case) is less than the printing width data (in this case, 4 mm+4 mm+8 mm+8 mm=24 mm) of the printing character sequence or not.

Since the printing width (24 mm) of the printing character sequence is not less than the width (18 mm) of the label tape 73, the control routine goes to step S20 and, as shown in 11D, the upper right end area of the display portion 22 displays "Err" message indicating that four-line printing is impossible.

In step S22, the display portion 22 displays the printing character sequence "ABC/CO., LTD./Ja/pan".

In step S23, the display portion 22 displays, from the upper left end thereof, the character size [2×2] corresponding to the cursor-designated character ("a" in this case), the tape width (18 mm) of the mounted tape cassette 70, and the printing length (5 cm) obtained by adding the paragraphing-impossible fourth-line printing character sequence "pan" to the printing length.

Specifically, by preparing the printing character sequence "ABC/CO., LTD. Jp/pan" and then setting a printing mode thereof, the user can know that the four-line printing conforming to the set format is impossible, and can also know in advance, on the display portion 22, that if the character sequence of the set format is printed, it will be printed on the 18 mm-width label tape **73*d* over the printing length of 5 cm. When the printing start key is operated, a printing action corresponding to the displayed message is executed in the printing portion 56, and thereby the tape shown in FIG. 12D** can be produced.

In an action which will now be described, the mounted 18 mm-width tape cassette 70D is replaced with the 9 mm-width tape cassette 70B and the mode switch key of the key input portion 21 is operated to select the printing mode in the state, similarly with the case illustrated in FIG. 11B, in which a printing character sequence "ABC/CO., LTD./Japan", consisting of a first line of "ABC" of character size [1×1], a second line of "CO., LTD." of character size [1×1], and a third line of "Japan" of character size [2×2], is stored in the printing data memory portion 52.

Like the above-described case, the process of S1 to S17 is executed.

In step S16, if it is determined that the data read out at this time is the stop code (STOP), it is considered that the read-out of the printing character sequence "ABC-/CO., LTD./Japan" has been completed and the sum printing width data (4 mm+4 mm+8 mm=16 mm), each-line maximum width-directional character size data (first line: [1]/second line: [1]/third line:[2]), and the maximum printing length data (third-line printing length) of the longest print-length line has been obtained.

In step S18, the tape width is discriminated. In this case, as is shown in. FIG. 6, the cassette presence/absence detection switch 41 is turned on, the first cassette discrimination switch 42 is turned off and the third cassette discrimination switch 44 is turned on, since the 9 mm width tape cassette 70B is mounted in the cassette mounting portion 13. Thus, a digital signal representing "1, 0, 1" is supplied from the switch detecting portion 55 to the control portion 51. As a result, it is determined that the tape width is 9 mm.

In step S19, it is determined whether the tape width (9 mm in this case) is less than the sum printing width data (in this case, 4 mm+4 mm+8 mm=16 mm) stored in the sum printing width register GW of the data memory portion 59 or not.

In step S19, "YES" is determined, and the control routine goes to step S20. As shown in 11E, the upper right area of the display portion 22 displays "Err" message indicating that three-line printing is impossible. Since the width (9 mm) of the tape **73*b*** is less than the sum printing width (4 mm+4 mm+8 mm=16 mm), the three-line printing conforming to the format set at the time of inputting the printing character sequence is impossible.

In step S22, the display portion 22 displays the printing character sequence "ABC/CO., LTD./Japan".

In step S23, the display portion 22 displays, from the upper left end thereof, the character size [2×2]corresponding to the cursol-designated character ("J" in this case), the tape width (9 mm) of the mounted tape cassette 70B, and the maximum printing length (11 cm) obtained by adding the paragphing-impossible third-line printing character sequence "Japan" to the printing length.

Specifically, by preparing the printing character sequence "ABC/CO., LTD. Japan" and then setting a printing mode thereof, the user can know that the three-line printing conforming to the set format is impossible, and can also know in advance, on the display portion 22, that if the character sequence of the set format is printed, it will be printed horizontally on the 9 mm-width label tape **73*b* over the printing length of 11 cm. When the printing start key is operated, the printing action corresponding to the displayed message is executed in the printing portion 56, and thereby the tape shown in FIG. 12E** can be produced.

Figure 13:
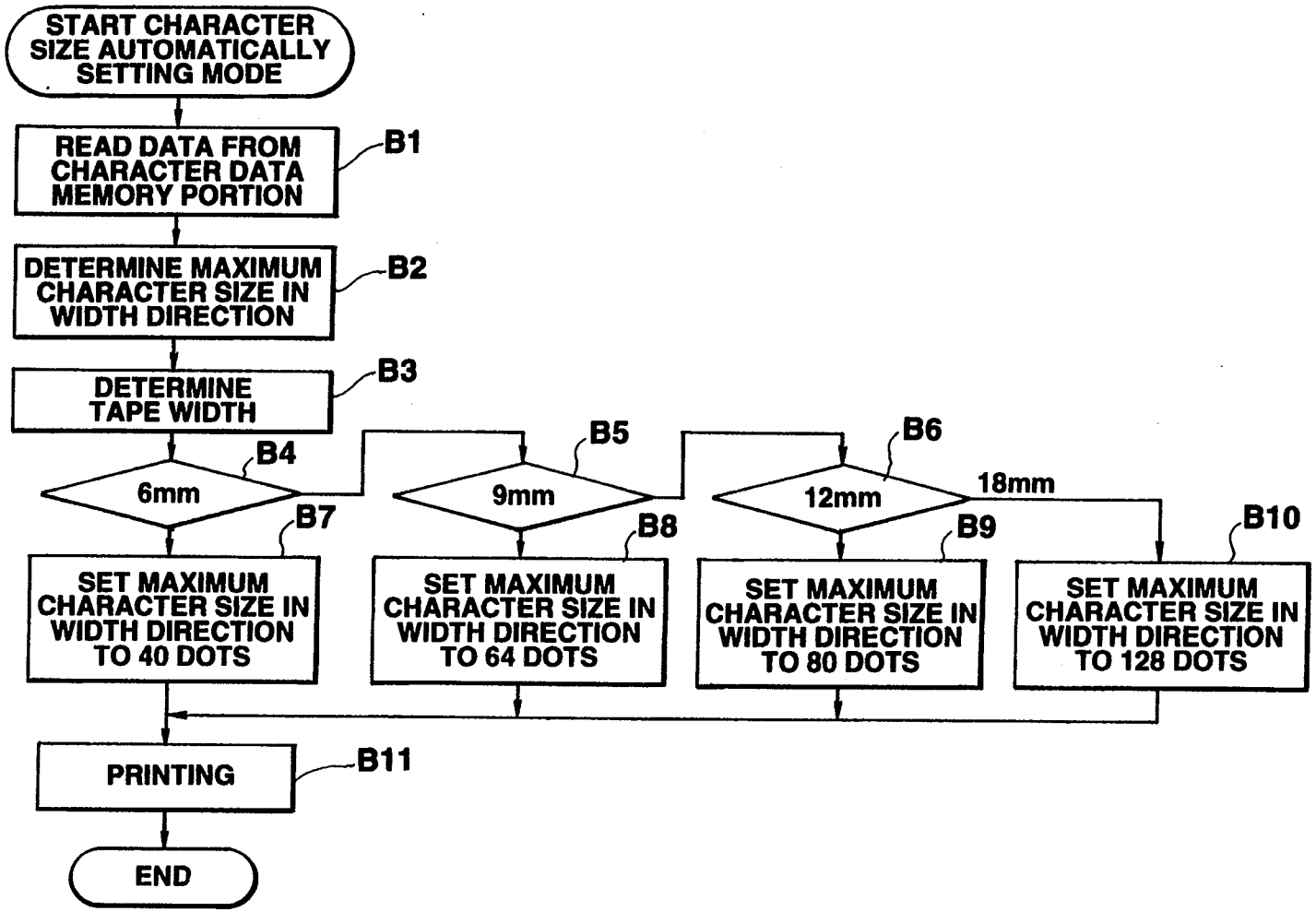
FIG. 13 is a flow chart for illustrating an action in a character size automatic setting mode of the control circuit shown in FIG. 5A.

Next, a case where a character size automatic setting mode is selected will now be described with reference to a flow chart of FIG. 13.

In step B1, the control portion 51 reads out successively character data of the printing character sequence from the printing data memory portion 52. In step B2, the maximum width-directional character size of the character data is determined.

In step B3, on the basis of the outputs from the first and second cassettes discrimination switches 42 and 44 through the switch detecting portion 55, it is determined that which one of the tape cassettes 70A, 70B, 70C and 70D is the mounted tape cassette 70, i.e. the tape width is determined.

In steps B4 to B6, it is determined that which one of 6 mm, 9 mm, 12 mm and 18 mm is the tape width determined in step B3.

If the tape width is 6 mm, the control routine advances to step B7 and the control portion 51 performs a pattern size conversion process so that the width-directional size of the character pattern of a character having the maximum width-directional character size may become 40 dots. Then, in step B11, a printing process is executed.

If the tape width is9 mm, the control routine advances to step B8 and the control portion 51 performs a pattern size conversion process so that the width-directional size of the character pattern of a character having the maximum width-directional character size may become 64 dots. Then, in step B11, a printing processing is executed.

If the tape width is 12 mm, the control routine advances to step B9 and the control portion 51 performs a pattern size conversion process so that the width-directional size of the character pattern of a character having the maximum width-directional character size may become 80 dots. Then, in step B11, a printing processing is executed.

If the tape width is 18 mm, the control routine advances to step B10 and the control portion 51 performs a pattern size conversion process so that the width-directional size of the character pattern of a character having the maximum width-directional character size may become 128 dots. Then, in step B11, a printing processing is executed.

FIG. 14A and FIG. 14B show examples of printed characters obtained by the above process, wherein "TOKYO JAPAN (STOP)" is input, character size [2×2] is set for "TOKYO", and character size [1×1] is set for "JAPAN".

Specifically, FIG. 14A shows a case where the 9 mm-width tape cassette is mounted. In this case, printing is effected with the width-directional size of "TOKYO" of the maximums width-directional character size being 64 dots. Since the character size of "TOKYO" is [2×2], one character is printed with 64 dots×64 dots.

FIG. 14B shows a case where the 18 mm-width tape cassette is mounted. In this case, printing is effected with the width-directional size of "TOKYO" of the maximum width-directional character size being 128 dots. Since the character size of "TOKYO" is [2×2], one character is printed with 128 dots×128 dots.

In this manner, by automatically setting the character pattern size in accordance with the tape width, a printing action matching with the tape width can be performed without changing the setting of the character size each time a tape cassette of a different size is mounted.

FIGS. 15A to 15E and FIG. 16 show another embodiment of the present invention.

FIGS. 15A to 15E are schematic plan views showing main parts of the embodiment.

In this embodiment, three cassette discrimination switches SWX, SWY and SWZ connected to the switch detecting portion 55 are provided on a given one of the placement portions 33 disposed in the cassette mounting portion 13 of the tape printer apparatus 10.

For this tape printer apparatus 10, eight kinds of tape cassettes 70 ($70_6$, $70_7$, $70_8$, $70_9$, $70_{10}$, $70_{11}$, $70_{12}$, $70_{13}$) containing tapes 73 having widths of 6 mm to 13 mm at intervals of 1 mm are prepared.

The positioning portions **71*b* of the tape cassettes are provided with notches 49** having shapes corresponding to the tape cassettes, i.e. the widths of contained tapes.

Figure 15A:
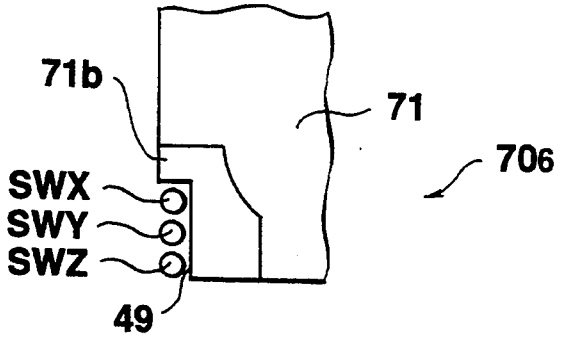
FIGS. 15A, 15B, 15C, 15D and 15E are partly enlarged plan views showing a relationship between tape cassettes and switches in states in which various tape cassettes are mounted in a tape printer apparatus according to another embodiment of the invention.
Figure 15B:
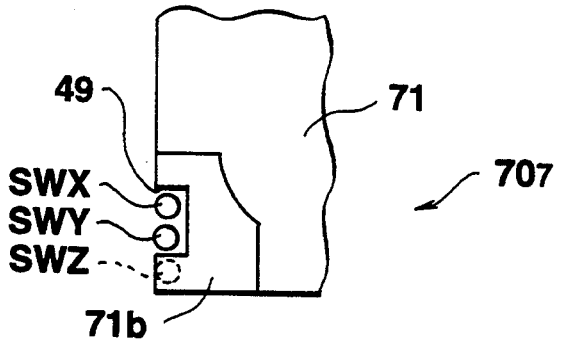
Figure 15C:
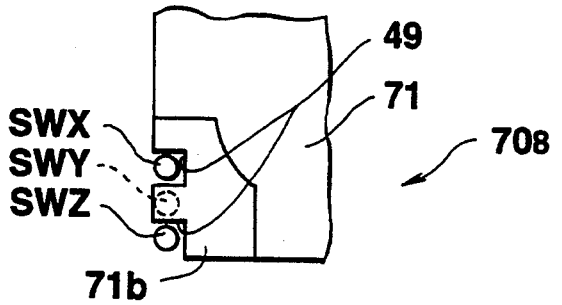
Figure 15D:
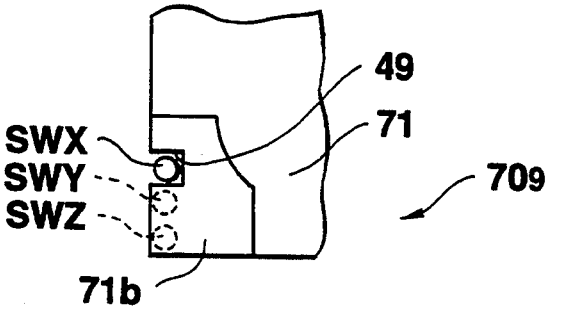
Figure 15E:
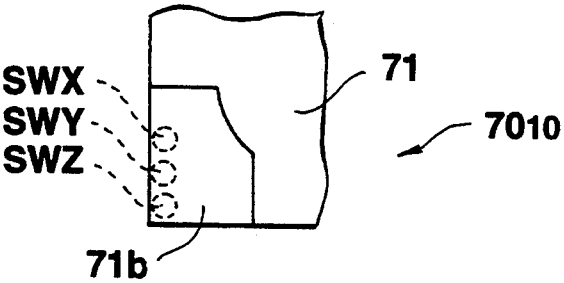

The notches 49 are formed such that they are selectively put in contact, or out of contact, with detectors of the switches SWX, SWY and SWZ. For example, the 6 mm-width tape cassette 706 is provided with the notch 49 as shown in FIG. 15A, the 7 mm-width tape cassette $70_7$ is provided with the notch 49 as shown in FIG. 15B, the 8 mm-width tape cassette 708 is provided with the notch 49 as shown in FIG. 15C, the 9 mm-width tape cassette $70_9$ is provided with the notch 49 as shown in FIG. 15D, and the 10 mm-width tape cassette $70_{10}$ is provided with the notch 49 as shown in FIG. 15E.

In this embodiment, too, as shown in FIG. 16, detection signals of the Switches SWX, SWY and SWZ are converted to 3-bit digital signals in the switch detecting portion 55 and input to the control portion 51.

Thus, the control portion 51 can determine the tape width of the mounted tape cassette 70 on the basis of the digital signals.

In the above-described embodiments, the kind of the tape cassette is discriminated physically, i.e. based on the combination of the notches and micro-switches. It is also possible, however, to attach optical identification marks on the tape cassettes and optically read the marks, or to attach magnetic identification marks on the tape cassettes and magnetically read the marks.

Additional advantages and modifications will readily occur to those skilled in the art. Therefore, the invention in its broader aspects is not limited to the specific details, and representative devices shown and described herein. Accordingly, various modifications may be made without, departing from the spirit or scope of the general inventive concept as defined by the appended claims and their equivalents.

What is claimed is:

1. A tape printer apparatus in which at least one of tape cassettes containing tape members of different widths is mounted, each of said tape cassettes having a projecting portion projecting in a length direction of the contained tape member at a position corresponding to a center in a width direction of the contained tape member, the projecting portion having a smaller width than the thickness of the tape cassette, and the projecting portion having a notch indicating the width of the contained tape member, said tape printer apparatus comprising:

a device case provided with a cassette mounting portion in which at least one of said tape cassette is mounted, and at an end portion of the cassette mounting portion, a receiving portion projecting from a bottom surface of the cassette mounting portion is provided, and a pressing member for pressing the tape cassette mounted in the cassette mounting portion to the bottom surface of the cassette mounting portion;

printing data input means for inputting data to be printed;

printing means for printing the input printing data on the tape member of said tape cassette mounted in the cassette mounting portion;

switch means which is turned on or off in accordance with the presence of absence of the notch in the projecting portion of said tape cassette mounted in the cassette mounting portion; and control means for controlling a printing action of said printing means in accordance with the on or off state of said switch means;

wherein the projecting portion of said tape cassette mounted in the cassette mounting portion abuts on the receiving portion to determine a position of said tape cassette in the cassette mounting portion when said tape cassette is mounted in the cassette mounting portion, so that the center positions in the width directions of the tape members of said tape cassettes are always positioned in an identical position in the cassette mounting portion when any one of said tape cassettes containing tape members of different widths is mounted in the cassette mounting portion.

2. A tape printer apparatus according to claim 1, wherein the receiving portion is provided with said switch means.

3. A tape printer according to claim 1, wherein said control means includes tape width detecting means for detecting a width of the tape member contained in the mounted tape cassette, on the basis of an output from said switch means.

4. A tape printer apparatus according to claim 3, further comprising tape width display means for displaying a tape width detected by the tape width detecting means.

5. A tape printer apparatus according to claim 1, wherein said control means comprises:

tape width detecting means for detecting a width of the tape member contained in the mounted tape cassette, on the basis of an output from said switch means;

printing width determining means for determining a printing width necessary for printing a printing data input by said printing data input means; and determination means for comparing the printing width obtained by the printing width determining means and the tape width obtained by the tape width detecting means, and determining whether the printing data can be printed within the tape width of the tape member or not.

6. A tape printer apparatus according to claim 5, further comprising display means for displaying whether printing is possible or not, on the basis of the determination result from the determination means.

7. A tape printer apparatus according to claim 6, wherein said control means includes means for changing a printing size of data when the determination means has determined that printing is impossible.

* * * * *